US007435183B2

(12) United States Patent
Tseng

(10) Patent No.: US 7,435,183 B2
(45) Date of Patent: Oct. 14, 2008

(54) SWING

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 167 days.

(21) Appl. No.: 11/440,744

(22) Filed: May 25, 2006

(65) Prior Publication Data

US 2007/0284926 A1 Dec. 13, 2007

(51) Int. Cl.
*A63G 9/12* (2006.01)
*A63G 9/00* (2006.01)

(52) U.S. Cl. ..... 472/125; 297/281; 472/118

(58) Field of Classification Search ..... 472/118–125; 297/273, 277, 281
See application file for complete search history.

(56) References Cited

U.S. PATENT DOCUMENTS 3,825,299 A * 7/1974 Gaucher ..... 297/157.1
5,803,818 A * 9/1998 Tseng ..... 472/118
5,902,187 A * 5/1999 Boring ..... 472/125
5,957,780 A * 9/1999 Grazioli ..... 472/118
6,001,021 A * 12/1999 Battaglia ..... 472/118
6,036,605 A * 3/2000 Tseng ..... 472/118
6,086,481 A * 7/2000 Li ..... 472/118
6,508,444 B1 * 1/2003 Tseng ..... 248/163.2
6,547,328 B2 * 4/2003 Liu ..... 297/245
6,949,027 B1 * 9/2005 Habing et al. ..... 472/118
6,994,631 B1 * 2/2006 Habing ..... 472/125

* cited by examiner

*Primary Examiner*—Kien T Nguyen
(74) *Attorney, Agent, or Firm*—Ladas & Parry LLP

(57) ABSTRACT

A swing includes: a pair of upright stands having top end portions; a transverse rod having two opposite end portions that are respectively secured to the top end portions of the stands; a pair of pivot sleeves sleeved respectively on the end portions of the transverse rod and rotatable on the transverse rod about an axis defined by the transverse rod; a seat frame disposed between the stands and below the transverse rod; and a pair of arcuate rods that extend curvedly from the seat frame and that are respectively secured to the pivot sleeves.

4 Claims, 5 Drawing Sheets

SWING

BACKGROUND OF THE INVENTION

1. Field of the Invention

The invention relates to a swing, more particularly to a swing having a stand unit and a seat frame pivoted to the stand unit through a pivot unit that is capable of preventing the seat frame from wobbling sidewisely during swinging of the seat frame.

2. Description of the Related Art

Referring to FIG. 1, a conventional swing includes a pair of upright stands 11 having top end portions, a transverse rod 12 extending between and secured to the top end portions of the stands 11, a pair of link members 13 suspended respectively from two opposite end portions of the transverse rod 12, a pair of hanging hooks 14, each of which is connected to a bottom end of a respective one of the link members 13, and a seat 15 suspended from the hanging hooks 14 through-two pairs of suspending rods 16 and operable to swing fro and to.

However, since the seat 15 is hooked to the hanging hooks 14, the seat 15 has a tendency to wobble sidewisely during swinging thereof, thereby undesirably colliding with the stands 11.

SUMMARY OF THE INVENTION

Therefore, the object of the present invention is to provide a swing that can overcome the aforesaid drawback associated with the prior art.

Accordingly, a swing of this invention comprises: a pair of upright stands having top end portions; a transverse rod having two opposite end portions that are respectively secured to the top end portions of the stands; a pair of pivot sleeves sleeved respectively on the end portions of the transverse rod and rotatable on the transverse rod about an axis defined by the transverse rod; a seat frame disposed between the stands and below the transverse rod; and a pair of arcuate rods that extend curvedly from the seat frame and that are respectively secured to the pivot sleeves.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
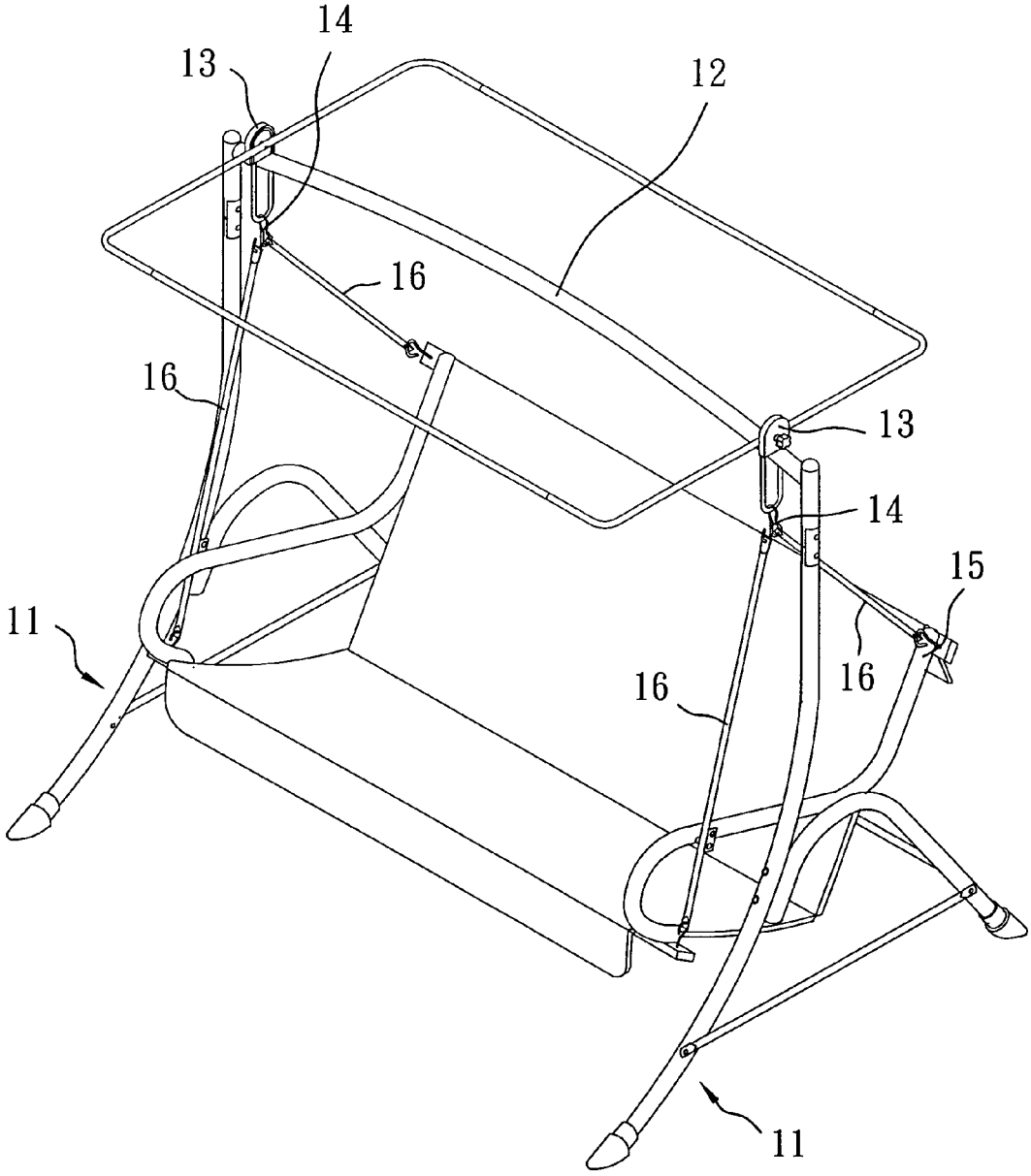
FIG. 1 PRIOR ART
FIG. 1 is an assembled perspective view of a conventional swing.
Figure 2:
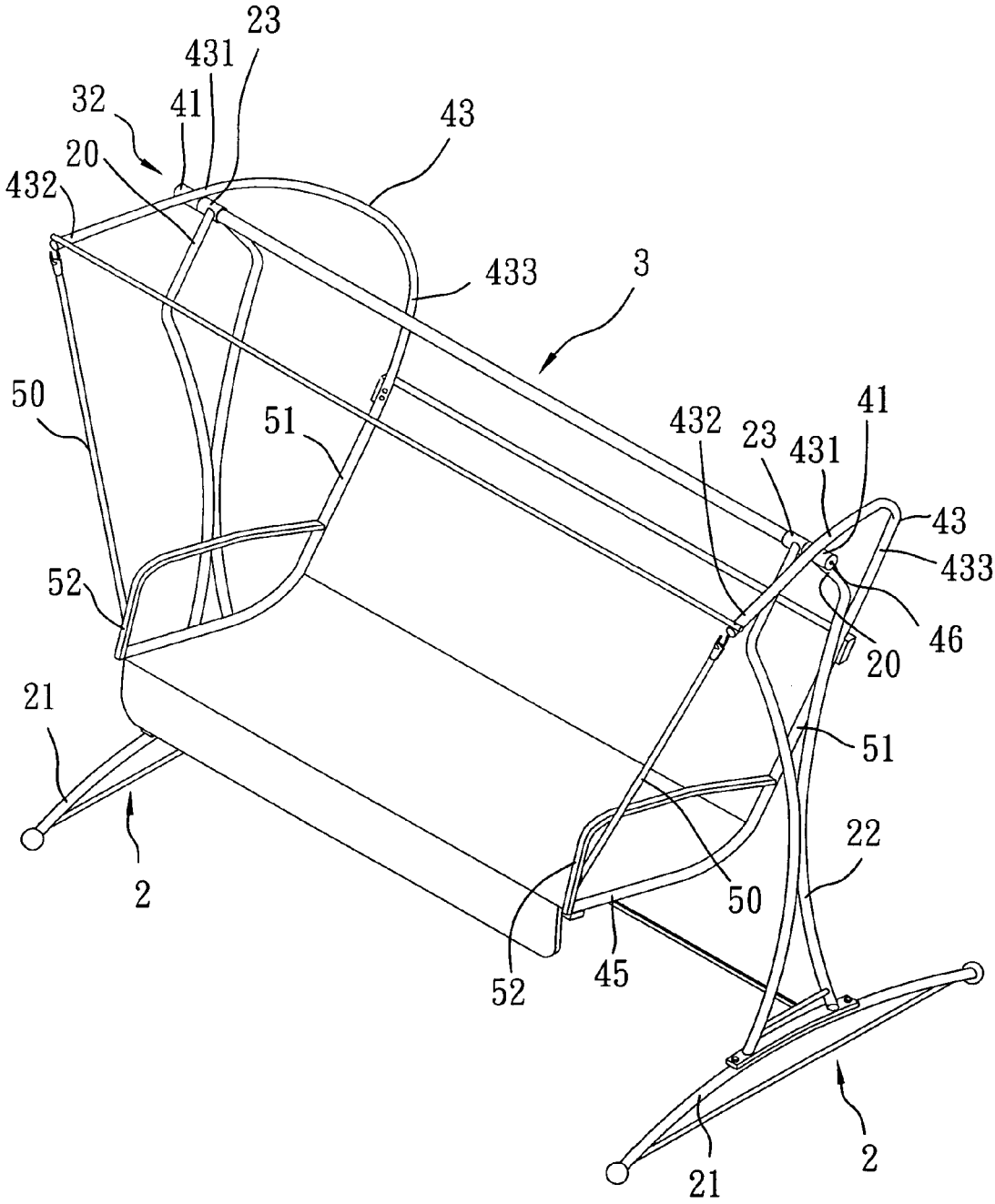
FIG. 2 is an assembled perspective view of the preferred embodiment of the swing according to the present invention.
Figure 3:
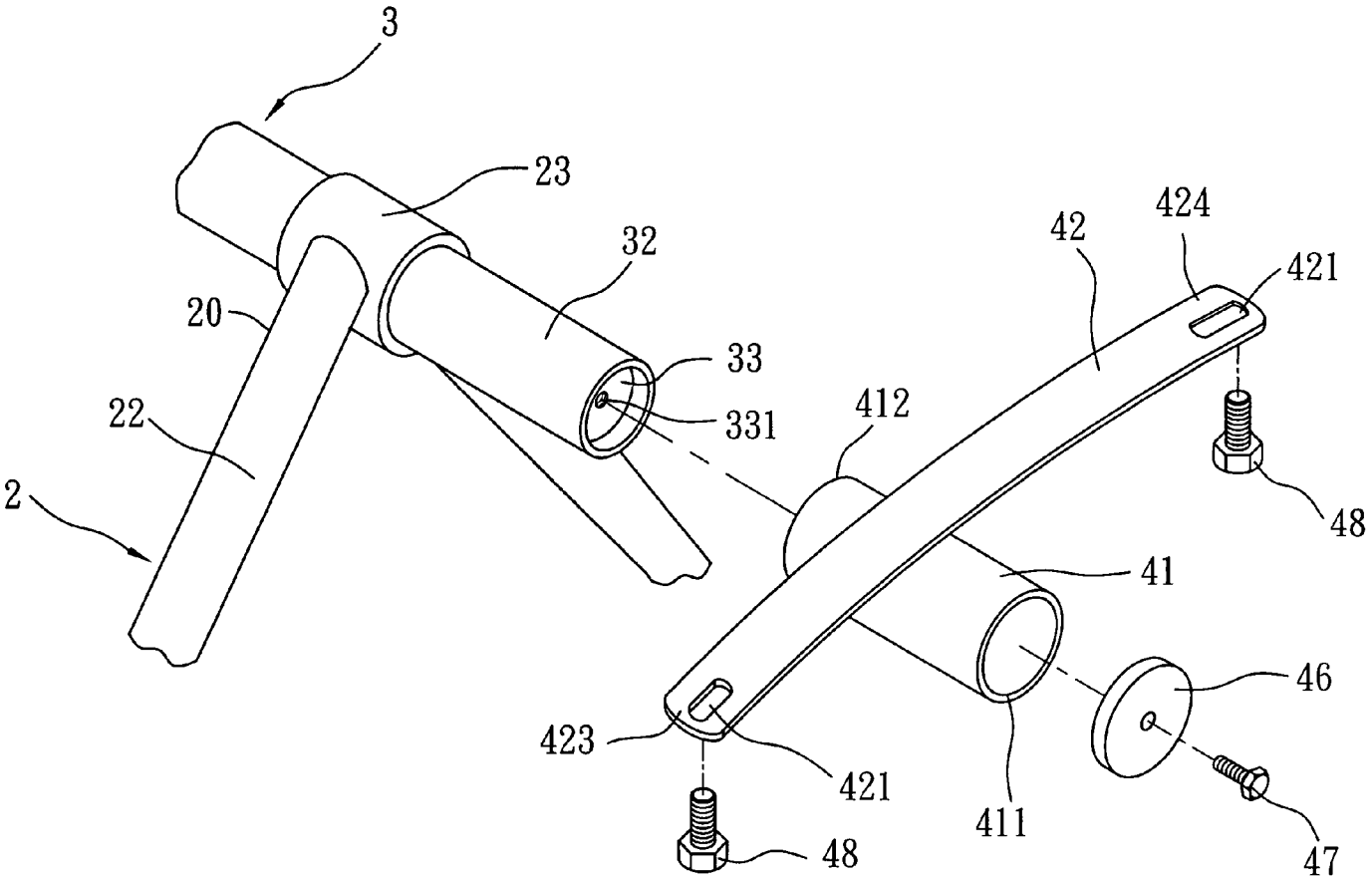
FIG. 3 is a fragmentary exploded perspective view illustrating how pivot sleeves and linking plates are coupled to a transverse rod of the preferred embodiment.
Figure 4:
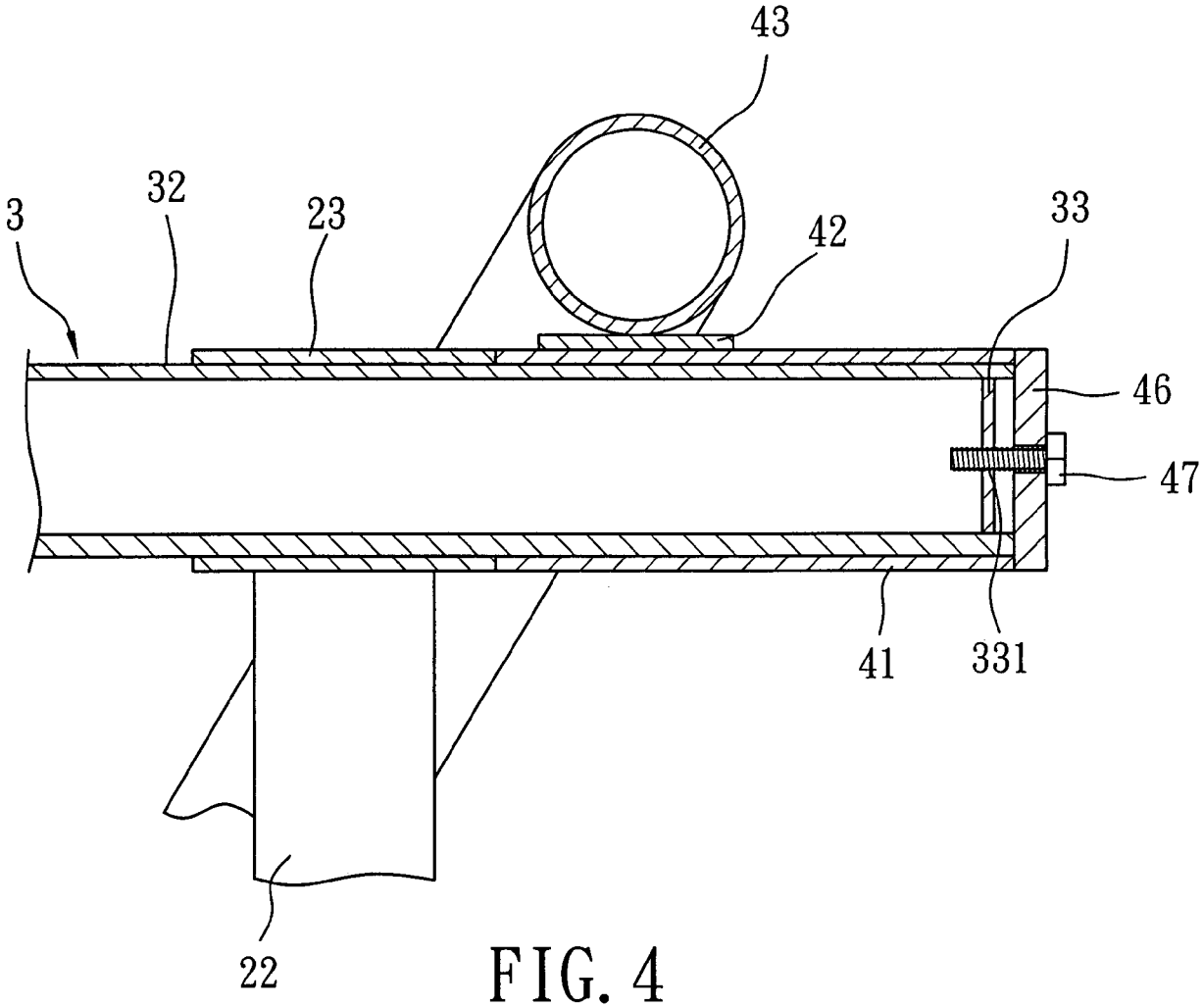
FIG. 4 is a fragmentary sectional view of the preferred embodiment.
Figure 5:
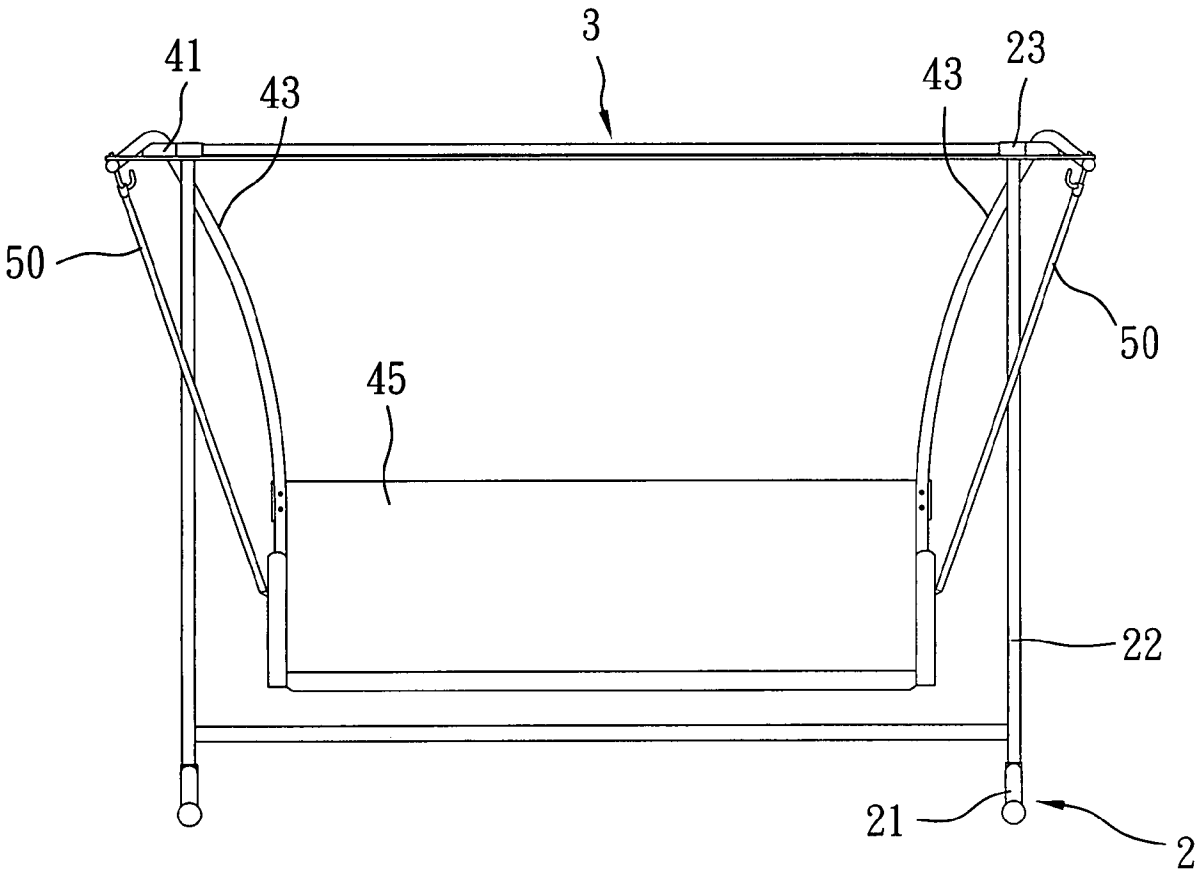
FIG. 5 is a schematic front view of the preferred embodiment.

Referring to FIGS. 2, 3 and 4, the preferred embodiment of a swing according to the present invention is shown to include: a stand unit having a pair of upright stands 2 with top end portions 20; a transverse rod 3 having two opposite end portions 32 that are respectively secured to the top end portions 20 of the stands 2; a pivot unit including a pair of pivot sleeves 41 sleeved respectively on the end portions 32 of the transverse rod 3 and rotatable on the transverse rod 3 about an axis defined by the transverse rod 3; a seat frame 45 disposed between the stands 2 and below the transverse rod 3; and a pair of arcuate rods 43 that extend curvedly from the seat frame 45 and that are respectively secured to the pivot sleeves 41.

Each of the stands 2 includes a stand base 21 for standing on the ground, and a plurality of upright rods 22 extending uprightly from the stand base 21. The top end portion 20 of each of the stands 2 is formed with a fixed sleeve 23 that is sleeved securely on a respective one of the end portions 32 of the transverse rod 3.

The transverse rod 3 has front and rear sides, and is hollow in this embodiment.

The seat frame 45 has a pair of backrest-supporting rods 51 disposed at the rear side of the transverse rod 3, and a pair of armrests 52 extending frontwardly and respectively from the backrest-supporting rods 51.

Each of the arcuate rods 43 is generally inverted U-shaped, and has a connecting arm portion 433 that extends upwardly from a respective one of the backrest-supporting rods 51, and a free arm portion 431 that is disposed opposite to the connecting arm portion 433, that crosses and that is secured to a respective one of the pivot sleeves 41, and that has a free end 432 disposed at the front side of the transverse rod 3. The swing further includes a pair of suspension rods 50, each of which is suspended from the free end 432 of a respective one of the arcuate rods 43, and each of which is secured to a respective one of the armrests 52.

Each of the pivot sleeves 41 has an outer end 411 and an inner end 412 opposite to the outer end 411. The swing further includes a fastening unit 6 having a pair of fixed plates 33, each of which is formed with a central threaded hole 331, is received in and is fittingly secured to the transverse rod 3, and each of which is disposed adjacent to a respective one of the end portions 32 of the transverse rod 3. The fastening unit 6 further includes a pair of fastening plates 46, each of which abuts against the outer end 411 of a respective one of the pivot sleeves 41, and a pair of screw bolts 47, each of which extends through a respective one of the fastening plates 46 to engage threadedly the central threaded hole 331 in a respective one of the fixed plates 33, thereby preventing undesired removal of the pivot sleeves 41 from the transverse rod 3. In addition, the inner end 412 of each of the pivot sleeves 41 abuts against a respective one of the fixed sleeves 23, thereby preventing undesired sidewise wobbling of the seat frame 45 during swinging of the seat frame 45.

The swing further includes a pair of elongate linking plates 42, each of which is disposed transverse to a respective one of the pivot sleeves 41, each of which is disposed between and is secured to the respective one of the pivot sleeves 41 and the free arm portion 431 of a respective one of the arcuate rods 43, and each of which has a middle portion 422 that is welded to the free arm portion 431 of the respective one of the pivot sleeves 41, and opposite front and rear ends 423, 424 that are respectively disposed at the front and rear sides of the transverse rod 3, and that are formed with fastener holes 421, respectively. The swing further includes a plurality of fasteners 48 for fastening the front and rear ends 423, 424 of each of the linking plates 42 to the free arm portion 431 of the respective one of the arcuate rods 43 through a respective one of the fastener holes 421.

A fabric cover (not shown) can be connected to and extended between the arcuate rods 43 to provide a shading function.

With the inclusion of the pivot sleeves 41 in the swing of this invention, the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is clamed is:

1. A swing comprising:

a pair of upright stands having top end portions;

a transverse rod having two opposite end portions that are respectively secured to said top end portions of said stands;

a pair of pivot sleeves sleeved respectively on said end portions of said transverse rod and rotatable on said transverse rod about an axis defined by said transverse rod;

a seat frame disposed between said stands and below said transverse rod; and a pair of arcuate rods that extend curvedly from said seat frame and that are respectively secured to said pivot sleeves;

wherein said transverse rod has front and rear sides, said seat frame having a pair backrest-supporting rods disposed at said rear side of said transverse rod, and a pair of armrests extending forntwardly and respectively from said backrest-supporting rods, each of said arcuate rods being generally inverted U-shaped and having a connecting arm portion that extends upwardly from a respective one of said backrest-supporting rods, and a free arm portion that is disposed opposite to said connecting arm portion, that crosses and that is secured to a respective one of said pivot sleeves, and that has a free end disposed at said front side of said transverse rod, said swing further comprising a pair of suspension rods, each of which is suspended from said free end of a respective one of said arcuate rods, and each of which is secured to a respective one of said armrests; and wherein said transverse rod is hollow, each of said pivot sleeves having an outer end, said swing further comprising a fastening unit including a pair of fixed plates, each of which is received in and is fittingly secured to said transverse rod and each of which is disposed adjacent to a respective one of said end portions of said transverse rod, said fastening unit further including a pair of screw bolts and a pair of fastening plates, each of which abuts against said outer end of a respective one of said pivot sleeves, each of said screw bolts extending through a respective one of said fastening plates to engage threadedly a respective one of said fixed plates.

2. The swing as claimed in claim 1, wherein said top end portion of each of said stands is formed with a fixed sleeve that is sleeved securely on a respective one of said end portions of said transverse rod, each of said pivot sleeves further having an inner end that is opposite to said outer end and that abuts against said fixed sleeve of said top end portion of a respective one of said stands.

3. The swing as claimed in claim 1, wherein each of said arcuate rods is generally inverted U-shaped and has a connecting arm portion that extends upwardly from said seat frame, and a free arm portion that is disposed opposite to said connecting arm portion, and that is disposed over, that crosses, and that is secured to a respective one of said pivot sleeves, said swing further comprising a pair of elongate linking plates, each of which is disposed transverse to a respective one of said pivot sleeves and each of which is disposed between and is secured to the respective one of said pivot sleeves and said free arm portion of a respective one of said arcuate rods.

4. The swing as claimed in claim 3, further comprising a plurality of fasteners, each of said linking plates having a middle portion that is welded to the respective one of said pivot sleeves, and opposite front and rear ends that are respectively disposed at front and rear sides of said transverse rod, each of said front and rear ends of each of said linking plates being fastened to said free arm portion of the respective one of said arcuate rods through a respective one of said fasteners.

* * * * *